US009897087B2

(12) United States Patent
Smith et al.

(10) Patent No.: US 9,897,087 B2
(45) Date of Patent: Feb. 20, 2018

(54) INVERTED AIR COMPRESSOR

(71) Applicants: Christopher Scott Smith, Huntington, WV (US); Glenn Edward Farrow, Barboursville, WV (US)

(72) Inventors: Christopher Scott Smith, Huntington, WV (US); Glenn Edward Farrow, Barboursville, WV (US)

( * ) Notice: Subject to any disclaimer, the term of this patent is extended or adjusted under 35 U.S.C. 154(b) by 0 days.

(21) Appl. No.: 14/324,034

(22) Filed: Jul. 3, 2014

(65) Prior Publication Data

US 2015/0010418 A1 Jan. 8, 2015

Related U.S. Application Data

(60) Provisional application No. 61/842,522, filed on Jul. 3, 2013.

(51) Int. Cl.

| | |
|---|---|
| ***F01C 21/18*** | (2006.01) |
| ***F04C 15/06*** | (2006.01) |
| ***F01C 1/356*** | (2006.01) |
| ***F04C 2/356*** | (2006.01) |
| ***F04C 18/356*** | (2006.01) |

(52) U.S. Cl.

CPC ..... *F04C 18/3564* (2013.01); *F04C 2240/20* (2013.01); *F04C 2240/603* (2013.01)

(58) Field of Classification Search

CPC ..... F04C 18/3564; F04C 2240/603

USPC ..... 418/241, 259, 266, 268, 267, 244, 246, 418/160–177, 263

See application file for complete search history.

(56) References Cited

U.S. PATENT DOCUMENTS

| | | | | |
|---|---|---|---|---|
| 2,055,296 | A | 9/1936 | Lane | |
| 2,391,360 | A * | 12/1945 | Stephens | F04C 2/46 418/176 |
| 3,008,424 | A * | 11/1961 | Roth | B60K 17/14 180/308 |
| 3,191,541 | A | 6/1965 | Brown | |
| 3,850,552 | A * | 11/1974 | Marcel | F04C 2/3443 192/58.2 |
| 4,345,886 | A | 8/1982 | Nakayama | |
| 4,611,472 | A | 9/1986 | Lum | |
| 4,772,185 | A * | 9/1988 | Hertell | F04C 18/39 418/172 |
| 6,824,369 | B2 | 11/2004 | Raymond | |

(Continued)

*Primary Examiner* — Mark Laurenzi
*Assistant Examiner* — Deming Wan
(74) *Attorney, Agent, or Firm* — Brian W. Foxworthy; Robert R. Waters; Waters Law Group, PLLC

(57) ABSTRACT

In many fields, such as manufacturing and mining, compressed air is used as a power source for industrial equipment, hand power tools, etc. Extensive compressed air systems are installed in these environments to supply compressed air where it is needed. In mining, extensive belts are frequently used to move mined material. Idler rollers are located intermittently along these belts. Embodiments of the present invention include compressors located within these idler rollers. As the belt moves and causes the roller to turn, a compressor within the roller generates compressed air. Because the belt moves nearly continuously, but the compressed air may not be consumed continuously, the air will be vented periodically. Embodiments of the present invention use these vents to clean the filters for the system. Also, some embodiments of the compressor may be produced using a laminated, or stacked, method.

10 Claims, 6 Drawing Sheets

(56) References Cited

U.S. PATENT DOCUMENTS

| | | | | |
|---|---|---|---|---|
| 6,881,041 | B2 * | 4/2005 | Lee | F04C 18/3568<br>417/356 |
| 2012/0141312 | A1 * | 6/2012 | Lee | F01C 21/02<br>418/66 |

* cited by examiner

INVERTED AIR COMPRESSOR

CROSS REFERENCE TO RELATED APPLICATIONS

This application claims priority to U.S. Provisional Application 61/842,522 filed on Jul. 3, 2013. The entirety of U.S. Provisional Application 61/842,522 including both the figures and specification are incorporated herein by reference.

FIELD OF THE INVENTION

The several embodiments of the current invention relate to remote and local supplies of compressed air. In particular, the several embodiments of the current invention relate to remote compressors driven by conveyor belts to supply compressed air at remote locations.

BACKGROUND OF THE INVENTION

Compressed air is used extensively to power tools and mechanical systems. For example, manufacturing plants have entire systems of compressors, surge tanks, and pipes located throughout them in order to provide supplies of compressed air to power air cylinders in manufacturing equipment, hand tools powered by compressed air, air-over-oil hydraulic systems, nozzles for cleaning equipment, etc. The piping is equipped for quick connect to the compressed air system and this includes "drops" throughout the plant where hoses drop from overhead pipes to supply compressed air at needed locations. In manufacturing plants, these systems can be built using generally centralized compressors and tanks with statically located pipes, hoses, and access points.

Underground mining also extensively employs hand tools and equipment powered at least partially by compressed air. However, because of the nature of underground mining, large centrally located air compressors and static piping infrastructure are not as practical. As the desired material is removed from the mines, the locations of high activity in the mines move. Additionally, the mining environment is a difficult environment to install elaborate infrastructure, such as static piping systems. Flexible hoses are not a desirable substitute for rigid piping systems since mining environments are very harsh with the coming and going of equipment posing risks of piercing and cutting the hoses, while equipment or debris could pinch off the hoses. Loss of air pressure for equipment relying on compressed air could have drastic consequences. There remains a need for means of providing compressed air to remote locations in underground mines as well as other above ground applications. Embodiments of the present invention have applications in other environments beyond mining, as well.

DESCRIPTION OF RELEVANT ART

U.S. Pat. No. 4,345,886 by Nakayama, et al discloses a rotary compressor for compressing fluid. A housing having a cylindrical internal cavity is provided with vanes and delivery ports. A rotor is rotatably mounted in the housing. The rotor has a portion for making a sealing contact with the inner peripheral surface of the housing. The rotor has a suction chamber formed therein. The number of the vanes is greater by 1 (one) than the number of the sealing contacts between the rotor and the inner peripheral surface of the housing. At least one suction port is formed through the wall of the rotor, so that the fluid in the suction chamber may be sucked into the working chamber defined by the vanes, rotor and the housing. The suction port is so located that, when a working chamber has been expanded to its maximum volume, the suction port is positioned between the vane located at the leading side of the working chamber as viewed in the direction or rotation of the rotor and the sealing portion closer to the vane. The fluid compressed in the working chamber is delivered to the outside of the housing through the delivery ports.

SUMMARY OF THE INVENTION

There are many types of air compressors and pumps. Each generally comprises a housing providing a fixed or grounded structure, moving elements within the housing to create changing volumes within the housing, and an input power shaft connected to the moving to power the moving elements within the housing. Embodiments of the present invention invert the arrangement of prior art pumps. The shaft connected to the elements internal to the housing is fixed, while the housing is allowed to turn. The housing is formed to have a cylindrical outer surface so that the housing itself can be turn by a belt.

As discussed above in the background section, compressed air systems are a common power system in industrial settings, and this includes mining operations. Conveyor belts are commonly featured in mining operations to move the mined material about. This includes moving the extracted material extensive distances underground from the location where it is mined, moving the material out of the mine, and moving the material along extensive distances above ground. These belts occasionally run over idler rollers which are located in multiple places along the length of the belts. The idler rollers are mounted at shafts protruding from each end of the roller, and the belts roll over them. Bearings can be used to reduce the drag on the rollers and belts. These bearings may be mounted about the ends of the shaft where the roller is mounted, or the bearings can be located within the roller between the shaft and the body of the roller.

Embodiments of the present invention utilize these idler pullers and the movement of the belt to provide localized sources of compressed air. An air compressor is located within an idler roller and as the belt passes over a roller and forces the idler roller to turn, the air compressor within the roller is powered and compressed air is generated. The compressed air is conducted from the roller via piping, valving, etc.

A common type of compressor is a vane compressor. The most common type of vane compressor has a cylindrical housing closed at each end with an opening for a shaft in at least one end. This opening for a shaft is eccentrically located and a shaft passes through the opening to drive a cylindrical internal compressor member. This cylindrical internal compressor member, or rotor, has slots in it around its outer radial surface, and these slots carry vanes. Springs located within the slots bias the vanes outward from the slots, and the vanes protrude from the surface of the rotor. With the eccentric location of the rotor, the rotor is closer to the internal surface of the housing on one side than it is on the other. The vanes in the rotor are long enough that they can maintain contact with the internal surface of the housing, including when the radial surface of the rotor is further away from the internal surface of the housing. Individual volumes are defined between each set of adjacent vanes, the rotor surface, the interior surface of the housing, and the endplates enclosing the housing. These volumes are larger where the rotor surface is further away from the housing and smaller where the rotor surface is closer to the housing.

When the rotor is turned, these volumes alternate between their maximum volume and minimum volume as they travel about the housing. When the volumes are increasing in size, ports in the housing allow fluid to flow into the housing and fill the volumes, while other ports in the housing allow fluid to exit the volumes and the housing, when the volumes are decreasing. This creates the effect of moving fluid through the housing. If the fluid is compressible, the mechanism may be called a compressor. If the fluid is incompressible, the mechanism may be called a pump.

Embodiments of the present invention move the vanes to slots in the interior surface of the housing and fix the interior element. The interior element, which would normally be a rotor, becomes a stator, and the housing becomes a rotor. The housing is turned about the interior element by the belt being pulled over the housing. The vanes carried by the rotating housing maintain contact with the interior element to create rotating volumes.

In some embodiments, the interior element is eccentrically located within the rotating housing. In these embodiments, the shaft on which the interior element is mounted is eccentrically located with respect to the interior element so that the shaft can be concentrically located with respect to the rotating housing. The rotating housing rotates about the shaft which is mounted and fixed in the same mounts that a regular inert idler roller is mounted. Because the interior element and the shaft are fixed in these embodiments, many of these embodiments will provide for fluid intake and exit through the shaft. Some embodiments may employ ports through side plates enclosing the ends of the housing. However, these endplates need to be fixed and exposed to access for piping.

Other embodiments of the invention may employ an interior stator element that is elliptical but concentrically fixed within the round housing. Each end of the elliptical stator makes a sealed contact line with the interior surface of the housing. As with other embodiments employing vanes, the vanes are carried by the housing which rotates about the stator. As the cylindrical rotor is rotated about the stator by a belt, the vanes in the rotor are moved along the surface of the stator. As a vane approaches a contact line between the stator and housing, the volume between that vane and the contact line decreases, and fluid is forced from that volume. Ports allow the intake and exit of fluid.

Appropriate fittings and piping leading from the shaft of the idler roller allows compressed air to be directed from the roller. The idler roller can be located anywhere an idler roller would be typically mounted and provides compressed air at local and remote locations without the need to install extensive compressed air systems. The power to generate the compressed air comes from the belt moving the material and is ultimately at a central source driving the belt.

In the prior art, there are also examples of vane compressors wherein the vanes are located in the outer housing instead of being located in the interior element. In at least one prior art reference the rotor has an elliptical shape and porting within it to allow fluid flow through the device. However, in this reference, the rotor is the interior element and it is the element that is turned by an external shaft.

In the locations where a belt is located, it is likely that the environment will be harsh, and the air will be full of contaminants and particulates. Because of this, filters typically associated with air systems will require more frequent maintenance or changing. However, the present invention incorporates a mechanism for decreasing the frequency of maintenance required. Although the belts in these environments run nearly continuously, the need for compressed air may not be a continuous need. This means that surge cylinders, or tanks, charged by the compressed air generators in the rollers will be fed compressed air even when no demand is placed on them. As the surge tanks reach the desired pressure, or rated limits, a poppet valve will allow compressed air to exhaust from the tanks This exhaustion of compressed air will occur periodically because the air compressor will run continuously when the belts are running Embodiments of a system incorporating the roller compressor employ this periodic release of air to clean the air filters for air intake for the compressor. The air exhausted through the poppet valve is directed through a line back at the air filter taking air into the compressed air system. This surge of air can be used in several ways. The surge of air can "shake" the filter element, the surge of air can be directed in the opposing normal flow of the filter to back-flush the filter, and/or the surge of air can be directed along the intake face of the filter to flush debris from the face. This periodic cleaning of the filter with the vented excess air decreases the frequency with which the filters need to be cleaned or replaced.

When an embodiment of the compressor of the present invention uses a vane style of compressor, it may be desirable to employ alternative means of constructing the rotor portion of the compressor. Creating a series of deep slots in the internal volume of a solid mass requires an expensive machining process. Certain embodiments of the present invention employing a vane compressor will therefore have the internal contour of the rotating housing constructed from a series of stacked plates having the desired contours and the desired slots in the plates. With a stack of plates, slots in each individual plate add up to a linear slot in the internal volume of the cylindrical housing. In addition to the avoidance of machining extensive slots into a solid mass, the stackable plates may have other slots where one or more plates combine to create ports and ducts to facilitate the intake and outflow of air from the air compressor.

BRIEF DESCRIPTION OF THE DRAWINGS

Additional utility and features of this invention will become more fully apparent to those skilled in the art by reference to the following drawings, wherein all components are designated by like numerals and described more specifically.

DETAILED DESCRIPTION OF EMBODIMENTS

Figure 1:
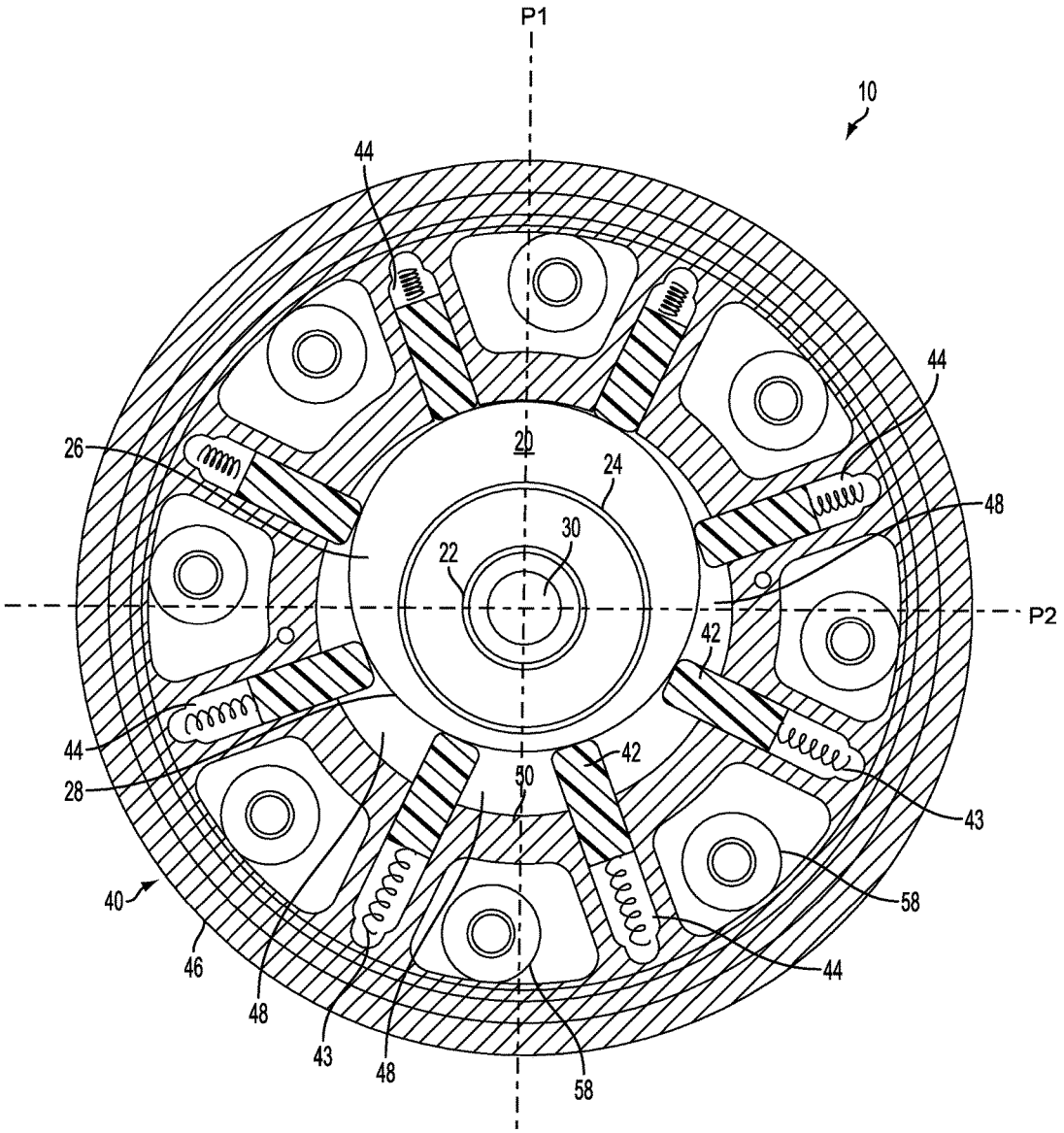
FIG. 1 is an end view of an embodiment of the invention with an end view of the stator and sectional end view of the rotor.

FIG. 1 is an end view of an embodiment of a compressor 10 according to the current invention with an end view of stator 20 and sectional end view of rotor 40. Stator 20 terminates in shaft 22 for mounting compressor 10 under a belt. Shoulder 24 on stator 10 provides a surface for the inner race of bearing to contact. Cam 26 of stator 20 is eccentric to shaft 22 and is therefore eccentrically located within rotor 40. Stator 20 is symmetrical about a first plane, P1, and asymmetrical about a second plane P2. First plane P1 and second plane P2 are orthogonal to each other.

Rotor 40 is concentric with shaft 22 of stator 20 and carries vanes 42 about stator 20 as rotor 40 turns. Vanes 42 are located in slots 44 in rotor 40 and are biased outwardly from slots 44, but radially inward toward cam 26. Vanes 42 are biased outward from slots 44 by suitable biasing elements. These biasing elements may be springs, elastomeric pads, etc. In FIG. 1, springs 43 are shown in two of slots 44 in rotor 40. Casing 46 around the outside of rotor 40 is contacted by a belt and turned by the belt to rotate rotor 40 about stator 20.

Vanes 42 maintain contact with surface 28 of cam 26 as they are moved about cam 26. Volumes 48 are defined between each set of two vanes 42, cam 26, interior surface 50 of rotor 40, and endplates that enclose the interior of rotor 40. Because of the eccentric location of cam 26 within rotor 40, the distance between cam 26 and interior surface 50 of rotor 40 varies about cam 26. This means the capacity of volumes 48 vary between a maximum and minimum as they rotate about cam 26. If a fluid is allowed into volumes 48 at their maximum and allowed out of volumes 48 as they decrease, fluid is moved through compressor 10.

Figure 2:
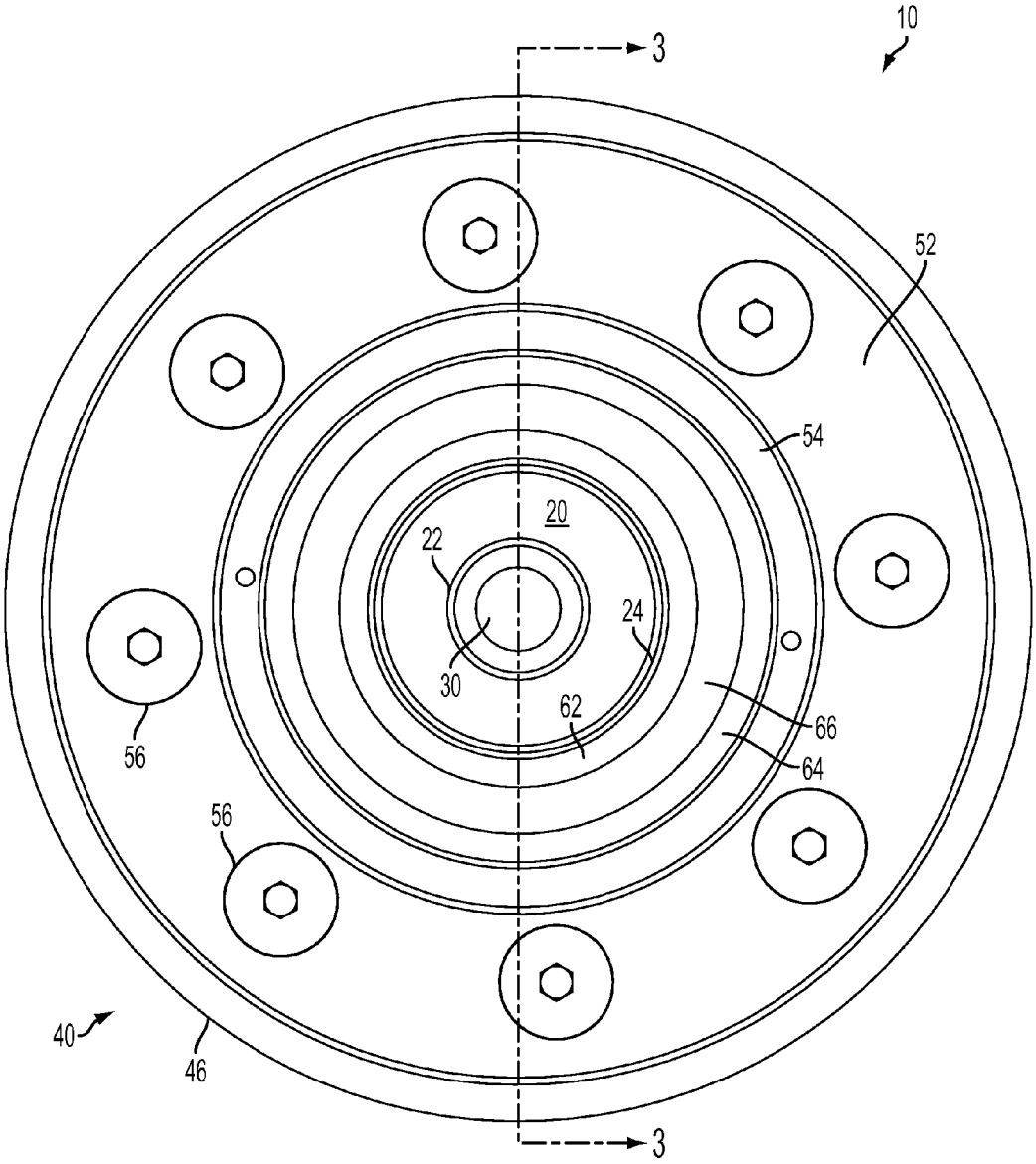
FIG. 2 is an end view of an embodiment of the invention.

FIG. 2 is an end view of an embodiment of a compressor 10 according to the present invention. Around the outside of rotor 40, casing 46 is visible, while endplate 52 encloses the inside of rotor 40. Shaft 22 and shoulder 24 of stator 20 are visible in FIG. 2 as well. Bearing 60 couples stator 20 to rotor 40 Inner race 62 of bearing 60 fits on shoulder 24 of stator 20, while outer race 64 of bearing 60 fits into flange 54 of endplate 52. Seal 66 of bearing 60 keeps contaminants out of bearing 60 and rotor 40. Bolt heads 56 around endplate 52 belong to bolts 58 which keep rotor 40 assembled. Returning to FIG. 1, bolts 58 may be seen in section view.

Figure 3:
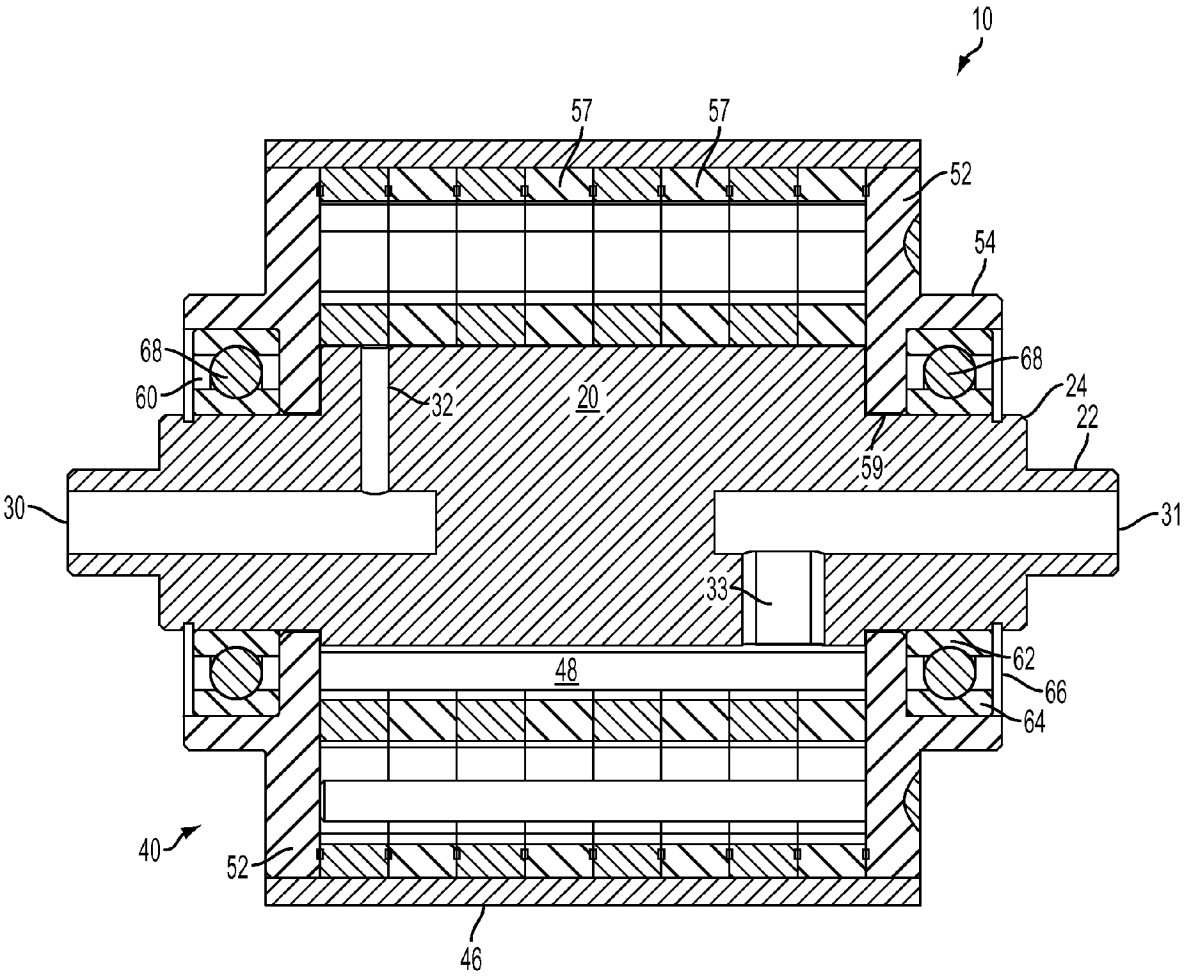
FIG. 3 is a side section view of the embodiment shown in FIG. 2 sectioned at the line shown in FIG. 2.

FIG. 3 is a side section view of the embodiment shown in FIG. 2 sectioned at the line shown in FIG. 2. In FIG. 3, stator 20 can be seen spanning from left to right through rotor 40. Inner races 62 of bearings 60 fit on shoulders 24 of stator 20, while outer races 64 of bearings 60 fit into flanges 54 of endplates 52. Rollers 68 in bearings 60 are shown as spherical in FIG. 3, but could be cylindrical or tapered depending on the specific application of the compressor and the expected loads on bearings 60. Apertures 59 in endplates 52 have a small clearance around shoulder 24 of stator 20 to allow rotation of rotor 40 with respect to stator 20.

As mentioned above, to move fluid through compressor 10, the fluid must be allowed to enter and exit volumes 48 within compressor 10. To that end, blind holes 30 and 31 extend from the ends of shafts 22 into the interior of stator 20. Ports 32 and 33 extend from the surface 28 of cam 26 to blind holes 30 and 31 respectively. Ports 32 and 33 act as intake and exhaust ports and are positioned generally radially out of phase with each other so that direct communication between them via a single volume 48 is not possible.

While the section view of FIG. 3 gives the impression that ports 32 and 33 are single ports, they may actually be a series of ports arranged through an angle about cam 26. This would allow intake into volumes 48 through more of the roughly 180° during which volumes 48 is increasing and allow exhaust from volumes 48 through more of the roughly 180° during which volumes 48 are decreasing as rotor 40 turns.

In FIG. 3, it can be seen that internal body of rotor 40 is comprised of a stack of plates 57. Each plate 57 has a series of radial slots in them so that when stacked, plates 57 form a cylinder with interior surface 50 and slots 44 extending from the interior surface 50 into the body of rotor 40. Plates 57 also have apertures through them spaced radially so that bolts 58 may pass through in order to hold rotor 40 together. The stacked method of constructing rotor 40 avoids the requirement of machining operations to mill out material to form slots 44 in a single cylindrical mass. The stacked assembly also provides a degree of modularity. Compressors of different capacities can be assembled by changing the number of plates. Other elements, such as vanes 42 would have to be changed as well.

Figure 4:
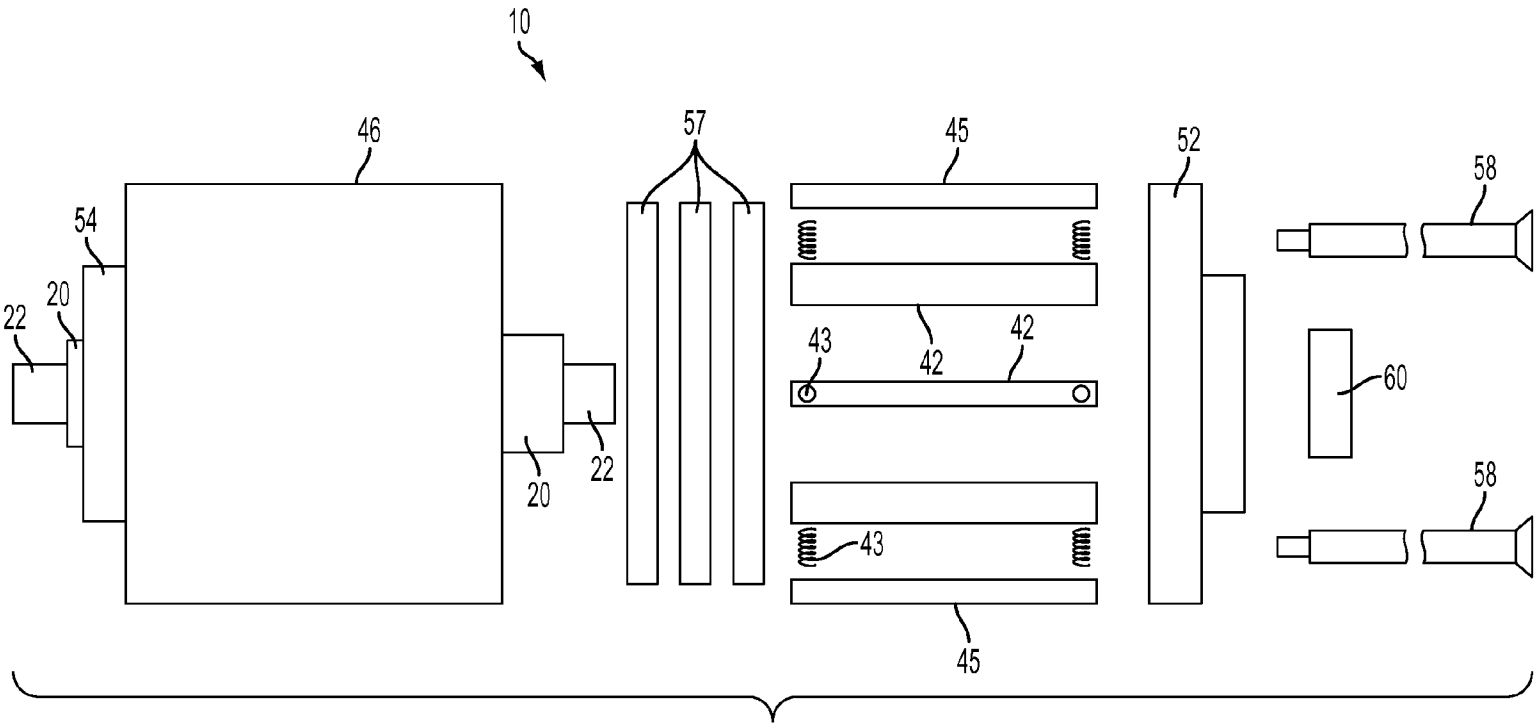
FIG. 4 is an exploded side view of the embodiment in shown in FIG. 3.

FIG. 4 is an exploded side view of the embodiment in shown in FIG. 3. In FIG. 4, casing 46 is at the left with stator 20 still in place within it. Other elements of compressor 10 are exploded out to the right. Just to the right of stator 20 are plates 57 which combine to form the interior body of rotor 40. Only a few plates 57 are shown in FIG. 4. Enough plates 57 are required to create a stack equivalent to the length of vanes 42 which are to the right of plates 57.

In FIG. 4, two vanes 42 are shown from the side, while one vane 42 is shown from the back. Additional vanes would be located between the vanes 42 shown, but they are omitted in FIG. 4. Springs 43 are located at the back of vanes 42 are serve to bias vanes 42 outward from their slots. Other biasing elements such as elastomeric pads could be used as well as other types of springs, such as leaf springs.

Above and below vanes 42 in FIG. 4 are keys 45. Keys 45 fit into slots on the inner diameter of case 46 and into notches in plates 57. This fixes the stack of plates 57 with respect to casing 46 so that all of rotor 40 turns as a unit with respect to stator 20. Other methods for securing plates 57 within casing 40 may also be used. For example, plates 57 may have tabs on them which match with slots on the inner diameter of casing 40.

Endplate 52 is displaced out to the right of vanes 42 and keys 45. Further to the right, bearing 60 fits into endplate 52 and around shaft 22. Bearing 60 allows rotor 40 to turn about stator 20. Bolts 58 pass through endplate 52 through plates 57 and on into its complementary endplate 52 at the opposite end of rotor 40.

Figure 5:
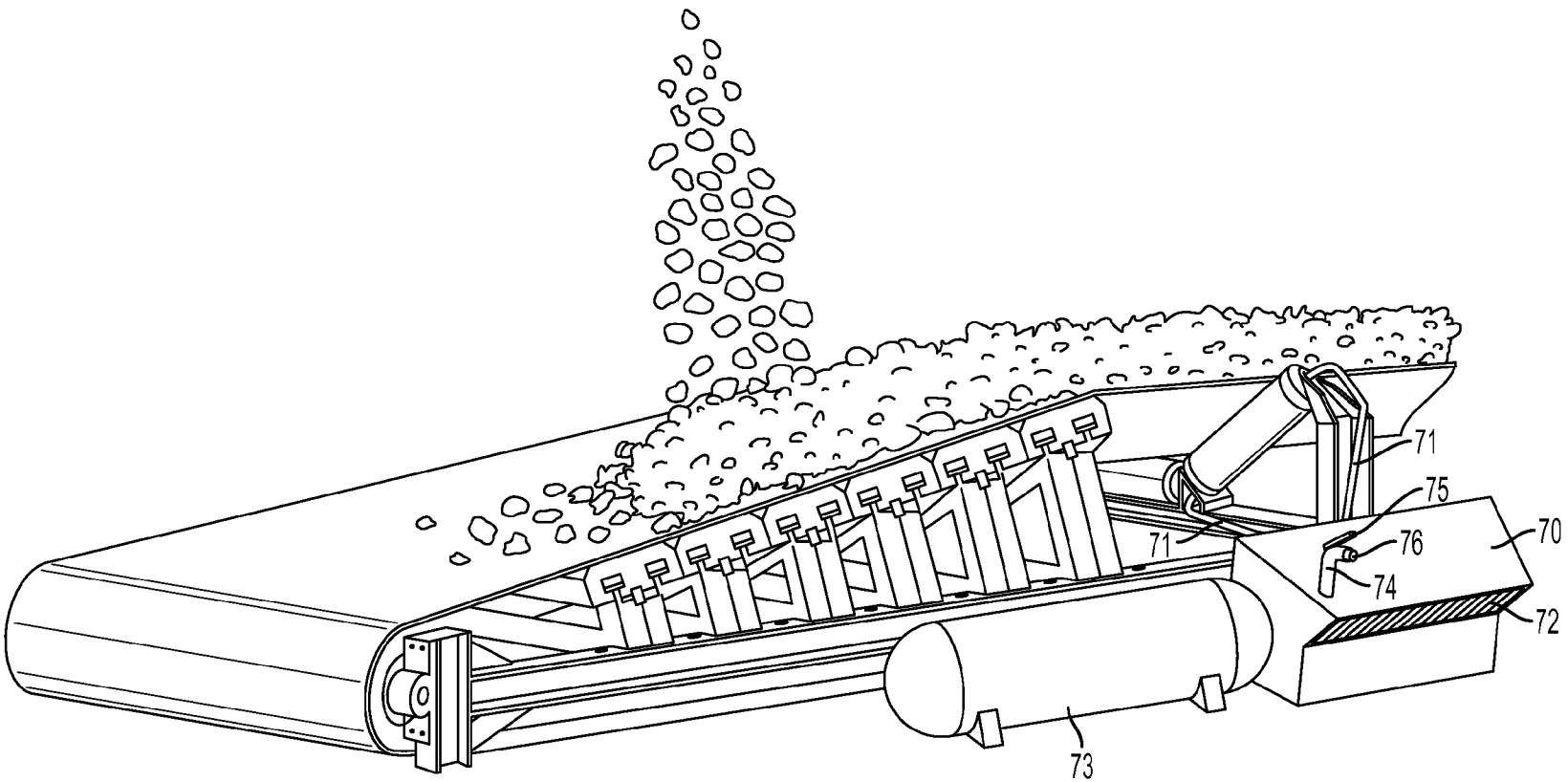
FIG. 5 is a perspective view of a conveyor with an embodiment of the invention installed as an idler roller and showing accompanying elements for the compressor.

FIG. 5 is a perspective view of a conveyor 80 with an embodiment of the invention installed as an idler roller, i.e. compressor 10, and showing accompanying elements for compressor 10. Piping 71 is connected to each end of compressor 10. Piping 71 connects to stator 20 which has apertures intake and exhaust at opposing ends. Piping 71 runs to cabinet 70 which encloses other elements of the air system. Filter 72 on the front of cabinet 70 removes contaminants from the air as it is taken into the system. Tank 73 stores compressed air. The pressure allowed to develop in tank 73 is controlled by a regulator located in cabinet 70 and not shown in FIG. 5. Because compressor 10 will be operating whenever conveyor belt 80 is moving, the regulator in cabinet 70 is especially important to avoid excessive pressure build up in the system. Fitting 74 with hand valve 75 extending from the top of cabinet 70 provide a coupler 76 to connect to the compressed air system provided by compressor 10, cabinet 70, and tank 73.

Cabinet 70 can contain other elements of the system such as a lubricator and self-cleaning features. The lubricator adds a small amount of lubrication to the air as it is taken in and proceeds to the compressor 10. The air carries the lubrication into compressor 10 to introduce lubrication into the internal workings of compressor 10. Conveyors such as conveyor 80 operate in remote areas and compressor 10 is intended as a remote source of compressed air. Because compressor 10 runs continuously with conveyor 80, the regulator in cabinet 70 will periodically vent tank 73. The vented air can be used to clean filter 72 in various ways. The air can power a shaker, it can be directed back through the filter, or those and/or other actions can be combined.

Figure 6:
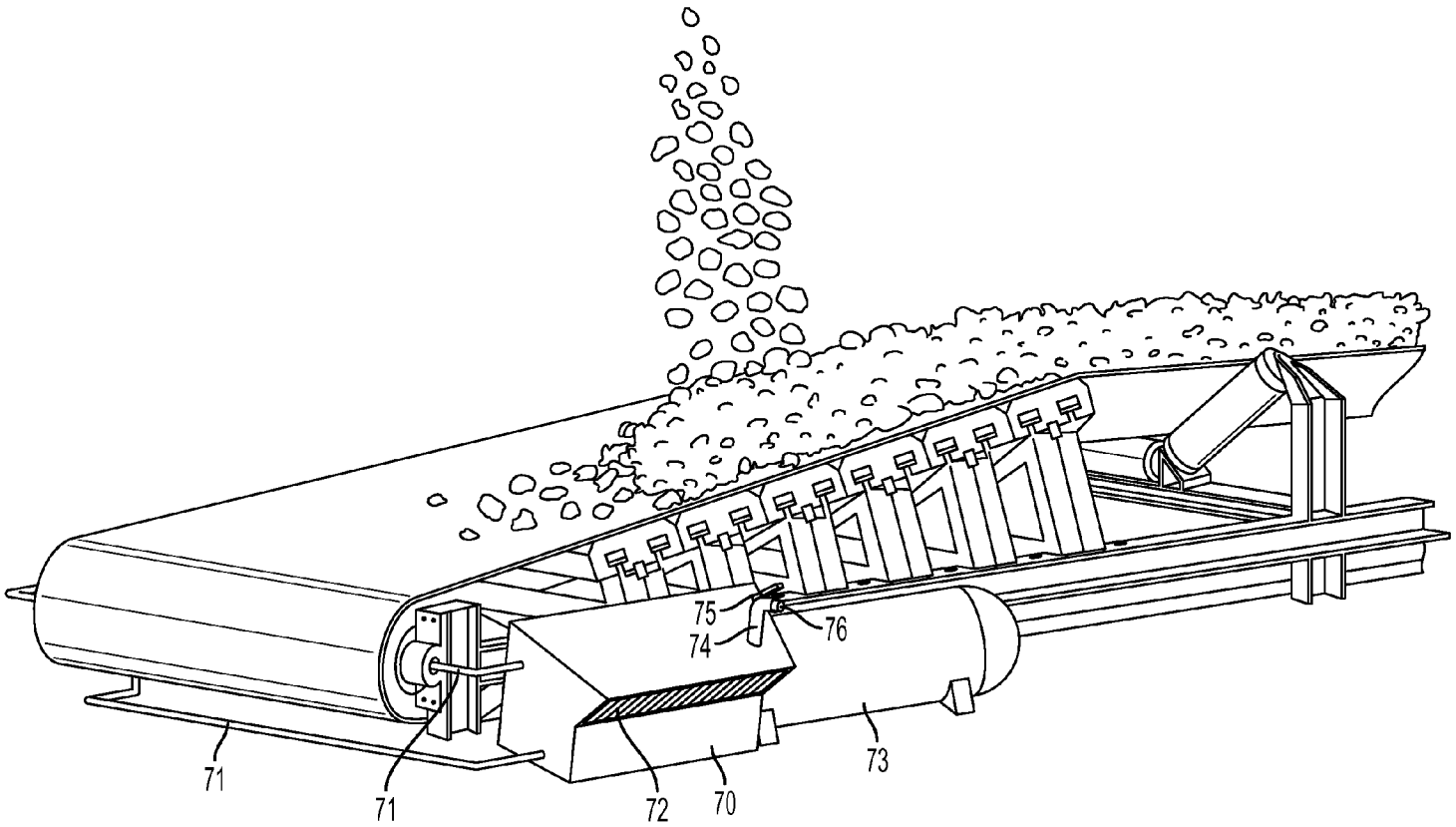
FIG. 6 is a perspective view of a conveyor with an embodiment of the invention installed in a different idler roller location than that of FIG. 5 and showing accompanying elements for the compressor.

FIG. 6 is a perspective view of conveyor 80 with an embodiment of the invention installed as a different idler roller than that of FIG. 5 and showing accompanying elements for the compressor. Similarly to FIG. 5, FIG. 6 shows tank 73 and cabinet 70 and connecting piping 71. Being a larger idler roller, compressor 10 in FIG. 6 has the opportunity for a higher volume compressor than that of FIG. 5. Alternatively, compressor 10 may only have working elements in a segment of the roller. Because the location in FIG. 5 only supports a segment of the belt, compressor 10 in FIG. 5 is more accessible from an installation and maintenance perspective than compressor 10 in FIG. 6.

While several embodiments of a compressor in an idler have been discussed above in the specification, it should be born in mind that these are not the only embodiments encompassed by the ensuing claims. Other compressor configurations could be fit within the idler roller and powered by the turning of the roller by a belt. Neither should the abstract or drawing figures be considered limiting. Rather the abstract is for overview purposes only and the drawing are to provide ease of understanding example embodiments. Additionally, although reference was made to the mining industry, it should be readily apparent that embodiments of the present invention are not limited application in the mining field.

We claim:

1. An inverted vane compressor comprising:

an external rotor and an internal stator located within said external rotor;

said external rotor comprising a concave cylindrical internal surface defining a cylindrical space symmetrical about a longitudinal axis, an exposed cylindrical external surface coaxial with said concave cylindrical internal surface, and two endplates, each said endplates enclosing opposing ends of said cylindrical space, each said endplate comprising a central aperture collinear with the axis of said cylindrical internal surface;

said internal stator comprising a body having the length of said cylindrical space and two ends, each said end of said body parallel to one of the respective endplate, each said end having a shaft extending through said central aperture of its respective endplate, said body being eccentrically located within said cylindrical space, said body being symmetrical about a first plane containing said longitudinal axis and asymmetrical about a second plane containing said longitudinal axis, said first plane and said second plane being orthogonal to each other;

said external rotor further comprising at least one vane operatively associated with said internal surface and biased to extend from said internal surface toward said axis of said internal surface said at least one vane maintaining contact with said body of said internal stator as said external rotor turns about said axis;

said internal stator further comprising an intake aperture in the shaft on one end and an exhaust aperture in the shaft on the other end, said intake aperture connecting to an intake port in the surface of said body and said exhaust aperture connecting to an exhaust port in the surface of said body, said intake port and said exhaust port being on opposite sides of said first plane from each other.

2. The inverted vane compressor of claim 1, wherein;

said concave cylindrical internal surface is a circular cylinder.

3. The inverted vane compressor of claim 1, wherein;

said external rotor further comprises a round cylindrical external surface coaxial with said concave cylindrical internal surface.

4. The inverted vane compressor of claim 1, wherein;

said external rotor comprises an outer casing, said outer casing containing a stack of rotor plates, each rotor plate being perpendicular to said longitudinal axis and comprising matching apertures coaxial with said longitudinal axis, said matching apertures in said plates combining to form said concave cylindrical internal surface.

5. The inverted vane compressor of claim 4, wherein;

said outer casing comprises a round cylindrical external surface coaxial with said concave cylindrical internal surface.

6. An inverted vane compressor comprising:

a rotor comprising a concave cylindrical internal surface defining a cylindrical space about a longitudinal axis, an exposed cylindrical external contact surface coaxial with said concave cylindrical internal surface, and two endplates, each said endplate enclosing opposing ends of said cylindrical space, each said endplate comprising a central aperture coaxial with the axis of said internal surface;

a stator comprising a body located within said cylindrical space, said body having the length of said cylindrical space and two ends, each said end of said body being parallel to each of the two endplates, said stator further comprising a shaft extending from each said end, each said shaft located eccentrically on its respective end, coaxial with the opposite shaft, and extending through said central aperture of its respective endplate, said body being eccentrically located within said cylindrical space by said shafts, said body being symmetrical about a first plane containing said longitudinal axis and asymmetrical about a second plane containing said longitudinal axis, said first plane and said second plane being orthogonal to each other, said stator further comprising an intake aperture in the shaft on one end and an exhaust aperture in the shaft on the other end, said intake aperture connecting to an intake port in the surface of said body and said exhaust aperture connecting to an exhaust port in the surface of said body, said intake port and said exhaust port being on opposite sides of said first plane from each other; and, at least one vane operatively associated with said internal surface of said rotor and biased to extend from said internal surface toward said axis of said internal surface, said at least one vane maintaining contact with said body of said stator as said rotor turns about said axis;

said rotor being driven about said stator by an external driver in contact with said external contact surface.

7. The inverted vane compressor of claim 6, wherein;

said concave cylindrical internal surface is a circular cylinder.

8. The inverted vane compressor of claim 6, wherein;

said external contact surface is a circular cylinder coaxial with said concave cylindrical internal surface.

9. The inverted vane compressor of claim 6, wherein;

said rotor comprises an outer casing, said outer casing containing a stack of rotor plates, each rotor plate being perpendicular to said longitudinal axis and comprising matching apertures coaxial with said longitudinal axis, said matching apertures in said plates combining to form said internal surface.

10. The inverted vane compressor of claim 9, wherein;

said outer casing comprises a circular cylindrical external surface coaxial with said internal surface.

* * * * *